US008398423B2

(12) United States Patent
Simmel et al.

(10) Patent No.: US 8,398,423 B2
(45) Date of Patent: Mar. 19, 2013

(54) CONTACTING PLUG AS WELL AS CONTACTING PLUG-IN CONNECTION

(75) Inventors: Andreas Simmel, Schwaikheim (DE); Wolfgang Pade, Illingen (DE); Michael Schoenfeld, Leinfelden-Echterdingen (DE); Michael Fleig, Ra Tilburg (NL)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 13/140,984

(22) PCT Filed: Nov. 6, 2009

(86) PCT No.: PCT/EP2009/064762

§ 371 (c)(1),
(2), (4) Date: Jul. 29, 2011

(87) PCT Pub. No.: WO2010/069673

PCT Pub. Date: Jun. 24, 2010

(65) Prior Publication Data

US 2011/0281456 A1 Nov. 17, 2011

(30) Foreign Application Priority Data

Dec. 19, 2008 (DE) ..... 10 2008 054 996

(51) Int. Cl.
*H01R 4/50* (2006.01)

(52) U.S. Cl. ..... 439/346

(58) Field of Classification Search ..... 439/346, 439/260, 61, 74–76; 339/61, 74–76
See application file for complete search history.

(56) References Cited

U.S. PATENT DOCUMENTS

| | | | | | |
|---|---|---|---|---|---|
| 3,130,351 | A | * | 4/1964 | Giel | 361/759 |
| 3,289,146 | A | * | 11/1966 | Tuchel | 439/743 |
| 3,478,301 | A | | 11/1969 | Conrad at al | |
| 3,594,699 | A | | 7/1971 | Jayne et al. | |
| 3,614,707 | A | * | 10/1971 | Kaufmann et al. | 439/59 |
| 3,710,303 | A | * | 1/1973 | Gallager, Jr. | 439/593 |
| 3,858,957 | A | * | 1/1975 | Harwood et al. | 439/59 |
| 4,269,462 | A | * | 5/1981 | Bethurum | 439/269.1 |
| 4,533,189 | A | * | 8/1985 | Scoccia et al. | 439/64 |

(Continued)

FOREIGN PATENT DOCUMENTS

| | | |
|---|---|---|
| DE | 10 2005 063 239 | 6/2007 |
| EP | 0 083 662 | 7/1983 |

(Continued)

OTHER PUBLICATIONS

International Search Report for PCT/EP2009/064762, dated Mar. 17, 2010.

*Primary Examiner* — Amy Cohen Johnson
*Assistant Examiner* — Vladimir Imas
(74) *Attorney, Agent, or Firm* — Kenyon & Kenyon LLP

(57) ABSTRACT

A contacting plug for contacting a contract carrier, in particular a circuit board, includes two clamping claws able to be swiveled relative to each other, transversely to a plug-in direction, at least one of the clamping claws being implemented as contact holder carrying at least one flexible contact element, which contact holder is designed to rest on the contact carrier with a contact force and has spring devices for generating a clamping force which is independent of the contact force. The clamping claws have at least one stop face in each case, which rest against each other in the non-contacting state of the contacting plug and thereby prevent plastic deformation of the contact element.

14 Claims, 2 Drawing Sheets

U.S. PATENT DOCUMENTS

| | | | | |
|---|---|---|---|---|
| 4,548,456 | A * | 10/1985 | Robertson | 439/373 |
| 4,934,961 | A * | 6/1990 | Piorunneck et al. | 439/637 |
| 4,996,766 | A * | 3/1991 | Piorunneck et al. | 29/842 |
| 5,823,823 | A * | 10/1998 | Longueville et al. | 439/571 |
| 6,176,722 | B1 * | 1/2001 | Longueville | 439/260 |
| 6,206,713 | B1 * | 3/2001 | Baertsoen et al. | 439/260 |
| 6,435,892 | B1 * | 8/2002 | Billman | 439/260 |
| 6,447,317 | B1 * | 9/2002 | Billman | 439/260 |
| 6,454,586 | B1 * | 9/2002 | Billman | 439/260 |
| 7,654,845 | B2 | 2/2010 | Buschle et al. | |

FOREIGN PATENT DOCUMENTS

| | | |
|---|---|---|
| EP | 0 083 862 | 7/1983 |

* cited by examiner

CONTACTING PLUG AS WELL AS CONTACTING PLUG-IN CONNECTION

FIELD OF THE INVENTION

The present invention relates to a contacting plug for contacting a contact carrier, especially a circuit board, and to a contacting connection which encompasses a contacting plug.

BACKGROUND INFORMATION

One known contacting connection, which includes a contacting plug as well as a contacting plug receptacle, is described in DE 10 2005 063 239. The contacting connection is characterized by the fact that the contact forces applied on a circuit board by contact elements are independent of clamping forces by which the clamping claws, which carry the contact elements and are developed as contact holders, rest on the circuit board. The contacting connection has shown to be reliable. However, there seems to be room for improvement insofar as damage to the contact elements may occur in the non-contacting state of the contacting plug, i.e., in the unplugged state, since the contact elements are pressed against the respective opposite clamping claw or against the opposite contact elements due to the elastic effect of the spring means.

SUMMARY

Example embodiments of the present invention improve the contact plug of the direct-contacting connection such that damage to the contact elements in the unplugged, non-contacting state of the contacting plug is avoided. Furthermore, a contacting connection is provided which includes a correspondingly improved contacting plug.

Example embodiments of the present invention are based on the idea of assigning at least one stop face to each clamping claw, and to dispose the stop faces such that the clamping claws are braced on each other via the stop faces in the unplugged state of the contacting plug, that is to say, whenever the clamping mouth formed by the clamping claws is not open. In this context it is important to place the stop faces such that the clamping claws are kept at a minimum distance from each other in the region of the contact elements, which prevents the (full) clamping force from acting on the contact elements. In other words, the provision of stop faces and their corresponding placement prevents at least a plastic deformation of the contact elements, which reduces the risk of damage to the contact elements in the unplugged state of the contacting plug to an absolute minimum.

In example embodiments of the present invention, the stop faces are advantageously placed such that not just a plastic deformation of the at least one contact element is prevented in the uninstalled, i.e., non-contacting, state of the contacting plug, but any type of deformation, that is to say, an elastic deformation as well. This reduces the risk of damage to the at least one contact element even further. In other words, according to example embodiments of the present invention, the stop faces are disposed relative to each other such that the at least one elastic, preferably metallic contact element does not touch the opposite clamping claw and/or an opposite contact element, so that the contacting element is not deformed as a result of the clamping forces which are generated by the spring and come to bear on the clamping claws.

In an arrangement of the contacting plug both clamping claws have at least two, preferably no more than two, stop faces in each case, which are placed at a distance from each other, transversely to a plug-in direction (mounting direction) of the contacting plug, the stop faces of the different clamping claws being disposed such that they interact in paired manner.

In example embodiments of the present invention, the stop faces are advantageously not situated in a center region of the contacting plug, but rather at the edge, that is to say, in the region of the longitudinal sides, preferably at the front corners of the contacting plug in the plug-in direction.

As previously elucidated, the stop faces, in other words, the spacer function, are/is set up for the unmounted state of the contacting plug. The spacer function is no longer required and also not desired in the plugged-in, i.e., mounted, state when contact is established with the contact holder. In this regard, in example embodiments of the present invention, it is advantageously provided that the mutually assigned stop faces are set apart from each other in the plugged-in state of the contacting plug.

It may be provided that the clamping claws are not arranged in one piece, as is the case in the related art, but as two separate components. In view of a simplified production and mounting, these are preferably non-varied parts, preferably plastic injection-molded components, which are interconnected in articulated manner via two swivel joints placed apart from one another transversely to the plug-in direction and implemented in the form of snap-in locking elements, in particular.

It is especially preferred if the contact carrier in the plugged-in, i.e., contacting, state braces itself via corresponding contact surfaces not adjacent to at least one circuit track and/or at least one land of the contact carrier, but rather directly on the circuit track or the land of the contact carrier, thus making it possible for the first time to compensate for manufacturing tolerances with regard to the thickness dimension of the circuit track or the land.

Especially preferred is an arrangement of the contacting plug in which the contact holder has at least one contact surface which defines the position of the contact element relative to the contact carrier. In other words, the clamping claws are preferably provided with one contact surface in each case, which ensures a defined relative position of the contact elements to the circuit board, or a defined relative position of the receiver trenches for the contact elements to the circuit board once the clamping claws are resting on the contact carrier in the final installation position, thereby bringing about defined prestressing of the preferably metallic, flexible contact elements, for instance in the manner illustrated and described in DE 10 2005 063 239. It is especially preferred if bracing of the contact surfaces on the contact carrier does not take place adjacent to the circuit tracks or lands, but directly on at least one circuit track or one land, in order to compensate for manufacturing tolerances in view of the thickness dimension of the circuit tracks or the lands.

In example embodiments of the present invention, the contacting plug is advantageously arranged as autonomous with regard to the magnitude of the clamping force at which the clamping claws, preferably implemented as contact holders, are resting against the contact carrier, especially a circuit board. Put another way, in example embodiments of the present invention, the clamping force of the contacting plug acting on the clamping claws is at least approximately, preferably completely, independent of a contacting plug receptacle.

This is preferably achieved in that in the final installation state of a contacting connection provided with the contacting plug, that is to say, with a contacting plug accommodated in the contacting plug receptacle, the spring devices no longer support themselves on the contacting plug receptacle for generating the clamping force, as is the case in the related art, instead support themselves solely on the contacting plug. The spring devices thus engage with the contacting plug exclusively, such that the clamping claws, at least one of which is arranged as contact holder supporting at least one elastic contact element, have a tendency to move towards each other. In still other words, the spring devices, which brace themselves solely on the contacting plug, preferably solely on the clamping claws, in order to generate the clamping force, oppose an opening movement of the clamping claws forced during a plug-in operation. Since according to the described example embodiments, the clamping force is no longer dependent on a change in form or a relaxation of the contacting plug receptacle, a drop below a minimally required clamping force is advantageously avoided. Furthermore, due to the special arrangement and placement of the spring devices, the structure of the contacting plug is able to be simplified considerably. It may even be possible to dispense with a contacting plug receptacle entirely.

It is especially preferred if the spring devices are arranged and disposed such that the clamping force generated by the spring devices, and the contact force generated by the at least one elastic contact element lie in a shared working plane.

In example embodiments of the present invention, the contacting plug is advantageously designed to interact with at least one mating plug element, which stresses the spring devices when the contacting plug is plugged in. The mating plug element preferably is part of a contacting plug receptacle mentioned in the introduction, and slipped into a corresponding receptacle (receiving channel) of the same when the contacting plug is plugged in, and it causes the clamping claws to widen during the slip-in process, i.e., relative swiveling of the same with respect to each other, that is to say, opening of the clamping mouth formed by the clamping claws, which in turn results in stressing of the spring means devices.

Example embodiments of the present invention provide a contacting connection which includes at least one previously described contacting plug to which a contacting plug receptacle is assigned, preferably one that is fixed in place on a contact carrier. The contacting connection preferably is an electrical direct plug-in connection for contacting circuit boards of control devices and/or components, especially for door control devices and/or engine control devices in motor vehicles.

Additional advantages, features and details of example embodiments of the present invention are described in the following description as well as from the figures.

DETAILED DESCRIPTION

Figure 1:
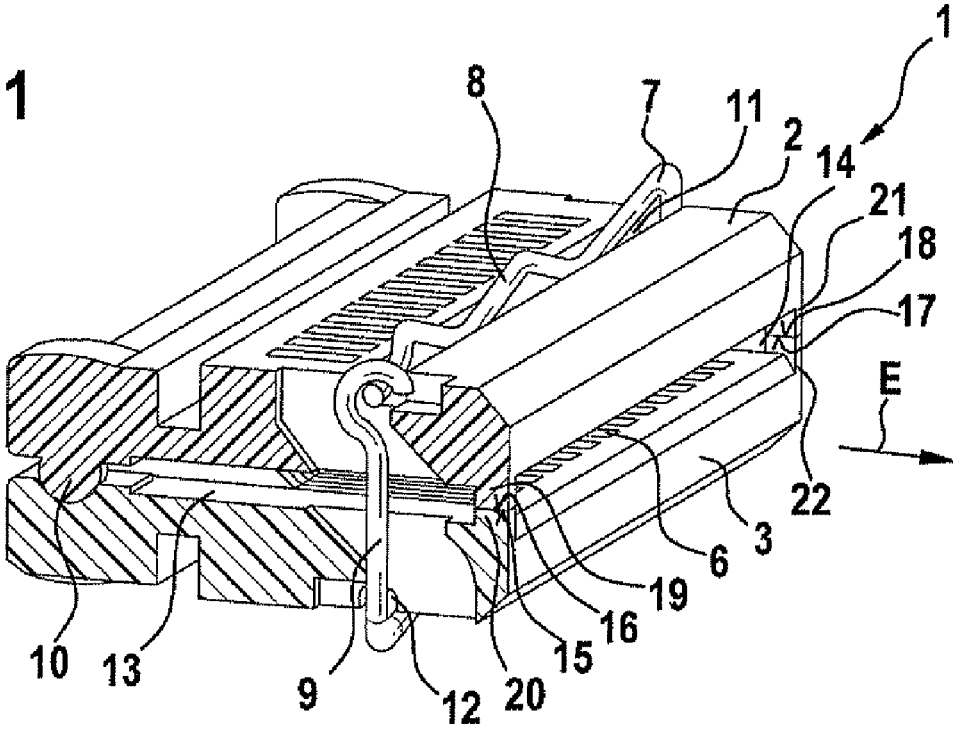
FIG. 1 a perspective view of an arrangement of a contacting plug, an illustration of an installation aid housing arranged as described in DE 10 2005 063 239, for example, which at least sectionally surrounds the clamping claws, being dispensed with for reasons of clarity.

Identical elements and elements having the same function have been provided with matching reference numerals in the figures.

FIG. 1 shows an incomplete view of one potential exemplary embodiment of a contacting plug 1 for the contacting of a contact carrier (not shown), which preferably is developed as circuit board. With the aid of contacting plug 1, an electrically conductive connection is able to be established between a cable harness (not shown) and the contact carrier. Contacting plug 1 includes two identically designed clamping claws 2, 3, which are disposed in mirror symmetry and implemented as contact holder 4, 5 in each case; in the exemplary embodiment shown, this contact holder 4, 5 carries a multitude of elastic contact elements 6 made of metal, which are disposed next to each other, transversely to plug-in direction E. They are used for the direct contacting of the contact carrier (not shown), more precisely, a circuit track or a land. Male multipoint connectors are intentionally dispensed with in this case. Contact elements 6 are developed as metallic spring elements, which are produced by bending and which rest against the contact carrier with a contact force essentially oriented perpendicular to the area coverage. The contact force at which contact elements 6 are resting against the contact carrier is independent of a clamping force by which clamping claws 2, 3 brace themselves on the contact carrier, substantially in the normal direction.

Spring devices 7, which are formed by two spring elements 8, 9 implemented in the form of wire spring elements, are provided for generating the clamping force. They are connected to each other in form-fitting manner and developed as non-varied parts in order to minimize the production costs and to simplify the installation. As can be gathered from FIG. 2, spring elements 8, 9 implemented as wire spring elements interlock with each other and thus form spring means 7 which are of a closed configuration over their periphery. In other words, spring elements 8, 9 form an annular spring element, which applies a spring force to clamping claws 2, 3 in a direction oriented towards each other. Instead of establishing a positive fit between spring elements 8, 9, they may additionally or alternatively be fastened to each other by soldering, welding, bonding or by some other type of fastening means, in particular of a mechanical nature.

As can be gathered from FIG. 1, clamping claws 2, 3 are implemented as separate components, which are connected to each other in articulated manner via two swivel joints 10 set up at a distance from each other, transversely to plug-in direction E; a development analogous to DE 10 2005 239 A1 having clamping claws 2, 3 which are integrally formed with each other is realizable as well, the clamping claws preferably being able to swivel via a film hinge.

Spring devices 7 are accommodated in grooves 11, 12, which extend transversely to the longitudinal extension of contacting plug 1 and guide spring devices 7. Spring elements 8, 9 sectionally engage with these grooves 11, 12, grooves 11, 12 being disposed such that they are situated in one plane with the contact points (not shown) at which contact elements 6 are resting against the contact carrier (not shown) from both sides. The contact forces and also the clamping force acting on clamping claws 2, 3 thus lie in a shared working plane. Connection lines 29 of a cable harness 30 connect contact elements 6 to corresponding electrical contacts 27 of contact carrier 25.

Instead of the spring devices formed by wire spring elements, it is also possible to use spring devices made from a preferably rubber-elastic elastomer material. It is also possible to use spring elements developed in the form of screw or helical springs, which apply tensile stress to clamping claws 2, 3.

As can furthermore be gathered from FIG. 1, a receiving channel 13, 14 is provided on each longitudinal side of contacting plug 1, which channel is delimited by clamping claws 2, 3 and extends in plug-in direction E. Receiving channels 13, 14 accommodate a mating plug-in element, which preferably is disposed on the contacting-plug receptacle (not shown in FIG. 1). Via leading slants, the mating plug-in elements ensure that clamping claws 2, 3 are swiveled relative to each other about swivel joints 10 when slipped into contact-plug receptacle, spring devices 7 being tensioned in this swivel operation, and a spring force being applied to clamping claws 2, 3 in a direction toward each other.

Moreover, it is apparent from FIG. 1 that clamping claws 2, 3 support themselves on each other by mutually assigned stop faces 15, 16; 17, 18 in the illustrated, unplugged state, i.e., the state when the contact carrier is not contacted. Stop faces 15, 16 or 17, 18 form stops that set clamping claws 2, 3 apart from each other in a region that is disposed at a distance from swivel joints 10 in plug-in direction E, such that no clamping force generated by spring devices 7 is applied to contact elements 6, thus advantageously preventing plastic deformation, and, in the exemplary embodiment, additionally elastic deformation, of contact elements 6 in the illustrated unplugged state of contacting plug 1. In the development according to FIG. 1, clamping claws 2, 3 are spaced apart from each other in a region between stop faces 15, 16; 17, 18 situated at a distance from each other, transversely to plug-in direction E, such that the contact elements of upper clamping claw 2 in the drawing plane do not touch opposite clamping claw 3 and its contact elements 6, and furthermore no contact is established between contact elements 6 of lower clamping claw 3 in the drawing plane and upper clamping claw 2 or contact elements 6 of upper clamping claw 2.

As can be gathered from FIG. 1, stop faces 15, 16; 17, 18 are formed on the front side of stop segments 19, 20; 21, 22 integrally developed with clamping claws 2, 3, which stop segments essentially extend in the direction of the clamping claw 2, 3 lying opposite in each case, perpendicular to plug-in direction E.

Figure 2:
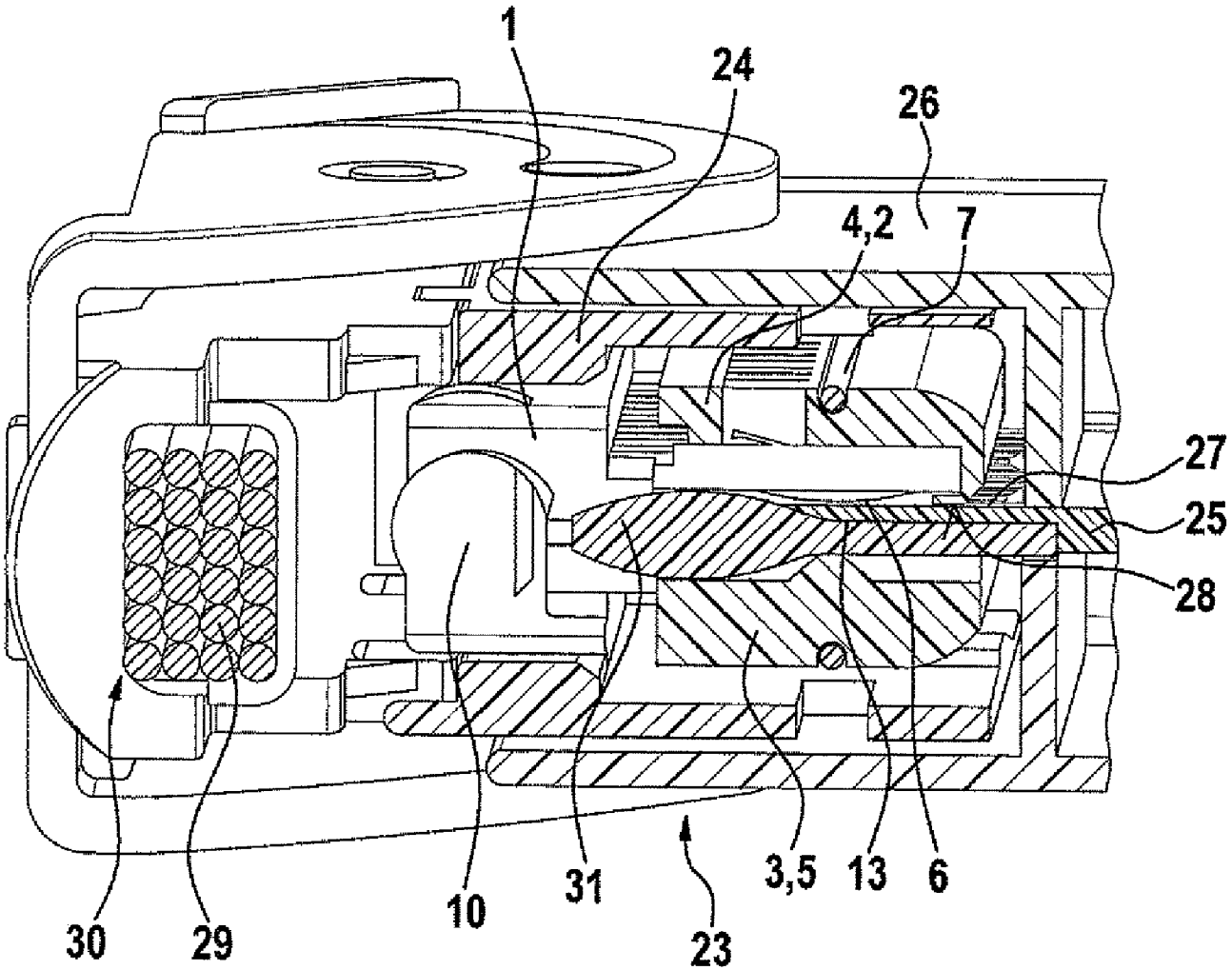
FIG. 2 a perspective, part-sectional view of a contacting connection with a contacting plug contacting a contact carrier, in this case, a circuit board.

FIG. 2 shows a mounted contacting connection 23. Visible is contacting plug 1, which together with its installation-aid housing 24 is accommodated in a contacting plug receptacle 26 that is fixedly connected to a contact carrier 25 implemented in the form of a circuit board. As can be gathered, spring devices 7 are not braced on contacting-plug receptacle 26. Contact elements 6, which are supported by contact holders 4, 5 or clamping claws 2, 3 and shown only partially, make direct contact with electrical contacts 27 implemented as circuit tracks, on both flat sides of contact carrier 25 realized as circuit board. Via contact surfaces 28, clamping claws 2, 3 support themselves directly on electrical contacts 27 and in this way define the position of contact elements 6 relative to electrical contacts 27, thereby resulting in an independence between the contact forces generated by contact elements 6 and the clamping forces generated by spring devices 7.

Stop faces 15 through 18 shown in FIG. 1, which prevent damage to contact elements 6 in the unplugged state of contacting plug 1, are not visible in the view according to FIG. 2 due to the placement of the sectional line.

FIG. 2 shows the position of a mating plug-in element 31, which is integrally formed with contacting plug receptacle 26 and spreads open the clamping mouth formed by clamping claws 2, 3 when it is slipped into the associated receiving channel, such that clamping claws 2, 3 are swiveled about associated swivel joints 10.

What is claimed is:

1. A contacting plug for contacting a contact carrier, comprising:

two clamping claws swivelable relative to each other, transversely to a plug-in direction, at least one of the clamping claws arranged as a contact holder carrying at least one flexible contact element, the contact holder adapted to rest on the contact carrier with a contact force; and a spring device adapted to generate a clamping force that is independent of the contact force;

wherein the clamping claws have stop faces affixed directly to longitudinal side edges of the contacting plug, the longitudinal side edges extending in a direction parallel to the plug-in direction, to maintain a contiguous clamping mouth opening and which rest against each other in a non-contacting state of the contacting plug and prevent plastic deformation of the contact element.

2. The contacting plug according to claim 1, wherein the stop faces are arranged such that the contact element does not touch an opposite clamping claw and/or an opposite contact element when the stop faces rest against each other.

3. The contacting plug according to claim 1, wherein both clamping claws have stop faces spaced apart from each other transversely to a plug-in direction.

4. The contacting plug according to claim 1, wherein the stop faces are disposed along an edge.

5. The contacting plug according to claim 1, wherein the stop faces are arranged such that they are set apart from each other in the contacting state of the contacting plug.

6. The contacting plug according to claim 1, wherein the clamping claws are arranged as components that are separate from each other, which are interconnected in articulated manner via two swivel joints set apart from each other transversely to the plug-in direction.

7. The contacting plug according to claim 6, wherein the clamping claws are non-varied injection-molded parts.

8. The contacting plug according to claim 1, wherein at least one contact surface for resting directly on at least one circuit track and/or one land of the contact carrier is arranged and situated on the at least one clamping claw implemented as a contact carrier, the contact surface defining a position of the contact element relative to the contact carrier.

9. The contacting plug according to claim 1, wherein to generate the clamping force, the spring devices are adapted to brace themselves on the contacting plug exclusively.

10. The contacting plug according to claim 1, wherein the contacting plug is adapted to interact with a mating plug-in element, which stresses the spring device when the contacting plug is plugged in.

11. The contacting plug according to claim 1, wherein the contacting carrier includes a circuit board.

12. A contacting connection, comprising:

a contacting plug according to claim 1, the contacting plug adapted to be plugged into a contacting plug receptacle assigned to a contact carrier.

13. The contacting connection according to claim 12, wherein the contract carrier includes a circuit board.

14. A contacting plug for contacting a circuit board, the contacting plug comprising:

two clamping claws which are able to be swiveled relative to each other transversely to a plug-in direction of the circuit board, at least one of the clamping claws implemented as at least one contact holder that (i) carries at least one flexible contact element, (ii) is designed to rest on the circuit board with a contact force, and (iii) includes a spring arrangement generating a clamping force independent of the contact force, the spring arrangement formed from wire spring elements that sectionally engage with grooves extending transversely to the plug-in direction of the circuit board and interlock with each other to form a closed configuration over a periphery of the clamping claws, wherein the two clamping claws each have at least one stop face affixed directly to a longitudinal side edge of the contacting plug extending in a direction parallel to the plug-in direction that rest against each other in a non-contacting state of the contacting plug and prevent deformation of the at least one flexible contact element, and wherein the spring arrangement rests exclusively on the contacting plug and applies a spring force on the two clamping claws in a direction toward each other.

* * * * *